US009963893B2

(12) United States Patent
Briggs

(10) Patent No.: US 9,963,893 B2
(45) Date of Patent: May 8, 2018

(54) BLEACHER HAVING AN INTEGRAL FRONT-AISLE STEP

(71) Applicant: HUSSEY SEATING COMPANY, North Berwick, ME (US)

(72) Inventor: Kerry D. Briggs, North Berwick, ME (US)

(73) Assignee: HUSSEY SEATING COMPANY, North Berwick, ME (US)

( * ) Notice: Subject to any disclaimer, the term of this patent is extended or adjusted under 35 U.S.C. 154(b) by 0 days. days.

(21) Appl. No.: 15/591,740

(22) Filed: May 10, 2017

(65) Prior Publication Data

US 2017/0328078 A1 Nov. 16, 2017

Related U.S. Application Data

(60) Provisional application No. 62/334,523, filed on May 11, 2016.

(51) Int. Cl.
*E04H 3/12* (2006.01)

(52) U.S. Cl.
CPC ..... *E04H 3/123* (2013.01)

(58) Field of Classification Search
CPC . E04H 3/123; E04H 3/12; E04H 3/126; E04F 11/022; E04F 11/035; E04F 2011/0203
USPC ..... 52/6, 8, 9, 179, 182, 188
See application file for complete search history.

(56) References Cited

U.S. PATENT DOCUMENTS 2,064,134 A * 12/1936 Weiland ..... A47G 27/06 52/179
3,488,898 A * 1/1970 Scaggs ..... E04H 3/123 182/132
3,869,835 A * 3/1975 Mackintosh ..... E04H 3/123 52/183

(Continued)

FOREIGN PATENT DOCUMENTS

EP 540804 A1 * 5/1993
FR 2608198 A1 * 6/1988 ..... E04H 3/12

OTHER PUBLICATIONS

Hussey Seating Company; "MAXAM Telescopic Gym Seating" Brochure, 2000.

(Continued)

*Primary Examiner* — Charles A Fox
*Assistant Examiner* — Joseph J. Sadlon
(74) *Attorney, Agent, or Firm* — Preti Flaherty Beliveau & Pachios LLP

(57) ABSTRACT

A front-aisle step that is integral with a deck of a bleacher and disposed in a bleacher access-aisle is disclosed. The first deck includes a deck surface having a deck surface height above a support surface and the front-aisle step has a front-aisle step surface having a height above the support surface that is less than the deck surface height. The front-aisle step has a front edge that is co-extensive with or recessed from a forward edge of the bleacher. In one embodiment a reversible platform is disposed in the access-aisle and in a first mounting orientation provides a front-aisle step surface at a height below the first deck surface and in a second mounting orientation in which the reversible platform is inverted from the first mounting orientation, the reversible platform provides a front-aisle step surface at a height generally co-planar with the first deck surface.

5 Claims, 8 Drawing Sheets

(56) References Cited

U.S. PATENT DOCUMENTS 4,045,921 A * 9/1977 Molloy ..... E04H 3/123 52/9
4,363,197 A * 12/1982 Aurit ..... E04H 3/123 52/9
4,934,113 A * 6/1990 Hall ..... E04H 3/123 182/223
5,347,774 A * 9/1994 Smith ..... B27M 3/12 144/354
5,743,053 A * 4/1998 Somerville ..... A62B 99/00 182/137
5,787,647 A * 8/1998 Dettmann ..... E04H 3/126 52/183
6,848,219 B2 * 2/2005 Standard ..... E04H 3/22 348/E5.108
6,854,216 B2 * 2/2005 Ahrens ..... A47C 1/126 52/183
8,627,608 B2 * 1/2014 Van Stokkum ..... E04H 3/12 52/6
9,650,796 B2 * 5/2017 Klingenberg ..... E04H 3/123
2002/0189177 A1 * 12/2002 Eve ..... E04F 11/112 52/184
2010/0024327 A1 * 2/2010 Kennedy ..... B29C 53/063 52/182
2011/0067316 A1 * 3/2011 Ortner ..... E04H 3/123 52/9
2016/0346157 A1 * 12/2016 Barto ..... A61H 3/00

OTHER PUBLICATIONS

Hussey Seating Company; "MAXAM Performance by Design" Brochure, 2002.

Hussey Seating Company; "MAXAM Seating Solutions" Brochure, 2007.

* cited by examiner

BLEACHER HAVING AN INTEGRAL FRONT-AISLE STEP

STATEMENT REGARDING FEDERALLY SPONSORED RESEARCH OR DEVELOPMENT

N/A

BACKGROUND OF THE INVENTION

The design of indoor telescopic seating systems ("bleachers") has evolved over the 65+ years since they were originally introduced and many of those design changes were driven by the need to improve safety. Specifically designated access-aisles in bleachers were one of the safety improvements. Before that enhancement people were forced to enter on and egress from a bleacher, across and on top of the seats themselves. Early access-aisles were referred to as "seat-level aisles" with an aisle way created by a walking surface constructed behind a seat at the same level as the seat in designated aisle areas. In such bleachers there were typically no front steps so the first step from the gym floor to the first seat-level aisle was at the first seat level, typically at 16" or greater.

Following the introduction of seat-level aisles, "foot-level aisles" were introduced in which the seats were totally removed in designated access-aisles and a person stepped from one deck up to the next—typically a rise of about 10" or 12". Again, with this generation of bleachers, the first step from the gymnasium floor to the first deck was at a height of about 10" to 12" above the floor. The building codes were eventually changed to require an "intermediate aisle step" mounted in the access-aisle on each deck to insure that the maximum riser height of any step on the bleacher did not exceed 8". Typically the step heights were about 5" to 6" (half of the bleacher deck rise: 10" to 12"). As a result of this code change limiting step risers to 8", a separate step was installed in front of the first row of seating and protruded onto the gymnasium floor. FIG. 1 illustrates a bleacher having a separate front-aisle step 100 and depicts how front-aisle steps are installed in almost all bleachers currently being deployed in the United States and many other countries.

Known front-aisle steps are usually a component that is separate from the bleacher system and placed in front of the bleacher. Consequently, such front-aisle steps must be individually positioned in front of the bleacher after the bleacher is opened and must be removed when the bleacher is closed. If a bleacher includes 6-10 aisles, then a front-aisle step must be separately positioned for each of the aisles. When not in use, the front-aisle steps are often stored in closets or in bleacher-storage positions. It is not uncommon for the front-aisle steps to be installed incorrectly, neglected to be installed or misplaced. The absence of a front-aisle step presents a safety hazard as well as a violation of current building codes. Persons exiting the bleacher may not be aware of the absence of the front-aisle step and suffer an injurious fall given the unexpected drop from the first deck to the gymnasium floor. Even when installed correctly, traditional front-aisle steps protrude from the front of the bleacher onto the gymnasium floor and may present a tripping hazard for spectators or coaches walking in front of the bleacher, or for athletes or other persons using the gymnasium. Consequently, even when the front-aisle steps are installed, it has been observed that, at times, they have subsequently been removed.

For the above reasons it would be desirable for a bleacher to have a construction that would comply with current building codes while avoiding the above-described disadvantages associated with the use of front-aisle steps that protrude outward from the front edge of a bleacher.

BRIEF SUMMARY OF THE INVENTION

In accordance with the present disclosure, a bleacher intended for installation on a support surface, such as a floor, is disclosed. The bleacher has a forward edge that extends the width of the bleacher in a longitudinal direction and includes at least first and second bleacher decks. The first and second bleacher decks have respective first and second bleacher deck surfaces that are disposed first and second deck surface heights above the support surface, wherein the height of the second deck surface above the support surface is greater than the height of the first deck surface above the support surface when the bleacher is disposed on the support surface.

The bleacher includes first and second seating structures that extend above the first and second deck surfaces respectively to provide seating for users of the bleacher. The seating structures are disposed in a longitudinal direction and have a forward edge that, in one embodiment, is generally co-extensive with the forward edge of the respective first and second decks. In an alternative embodiment, the seating structures are disposed adjacent the rearward edge of the deck surfaces. One or more gaps are provided in the longitudinally extending seating structures to define one or more access-aisles extending in a direction generally transverse to the longitudinal direction to permit user ingress to and egress from the bleacher.

One or more members are configured as front-aisle steps that are disposed in one or more corresponding access-aisles to provide a front-aisle step surface proximate the forward edge of the bleacher as an initial step for user ingress onto the bleacher. The front-aisle step surface is disposed at a first step surface height above the support surface that is less than the height of the first deck surface above the support surface. The one or more front-aisle steps have a front edge that is generally co-extensive with or recessed from the forward edge of the bleacher so as not to protrude therefrom and present a tripping hazard.

In another embodiment, one or more reversible trays or platforms are configured for mounting on or to the bleacher in one or more corresponding access-aisles. The reversible platforms are configured so as to provide a front-aisle step surface substantially at the first step surface height that is below the first deck surface height when the reversible platform is disposed in the access-aisle in a first platform mounting orientation and to provide a front-aisle step surface that is disposed at a second step surface height with respect to the support surface that is greater than the first step surface height when the reversible platform is inverted and disposed in the access-aisle in a second platform mounting orientation. In one embodiment, the second step surface height is substantially co-planar with the first deck surface. A forward edge of the reversible platform is substantially co-extensive with the forward edge of the bleacher or recessed therefrom when the reversible platform is disposed in either the first or second platform mounting orientation.

BRIEF DESCRIPTION OF THE SEVERAL VIEWS OF THE DRAWINGS

The invention will be better understood by reference to the following Detailed Description of the Invention in conjunction with the Drawings of which.

DETAILED DESCRIPTION OF THE INVENTION

The disclosure of U.S. provisional application 62/334,523 filed May 11, 2016 titled Bleacher Having and Integral Front-Aisle Step is incorporated herein by reference in its entirety.

Figure 3:
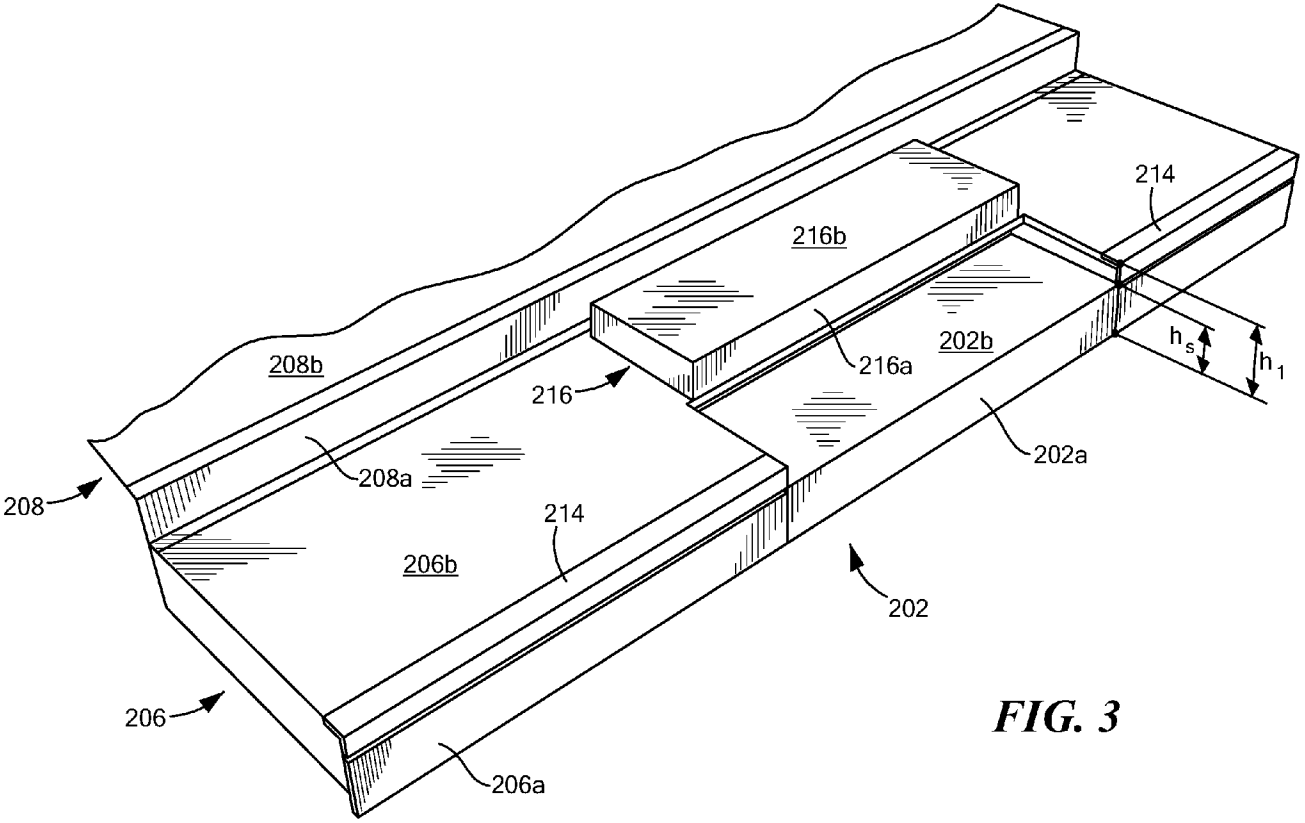
FIG. 3 is a perspective view of the portion of the bleacher of FIG. 2 with the bleacher seating removed.
Figure 4:
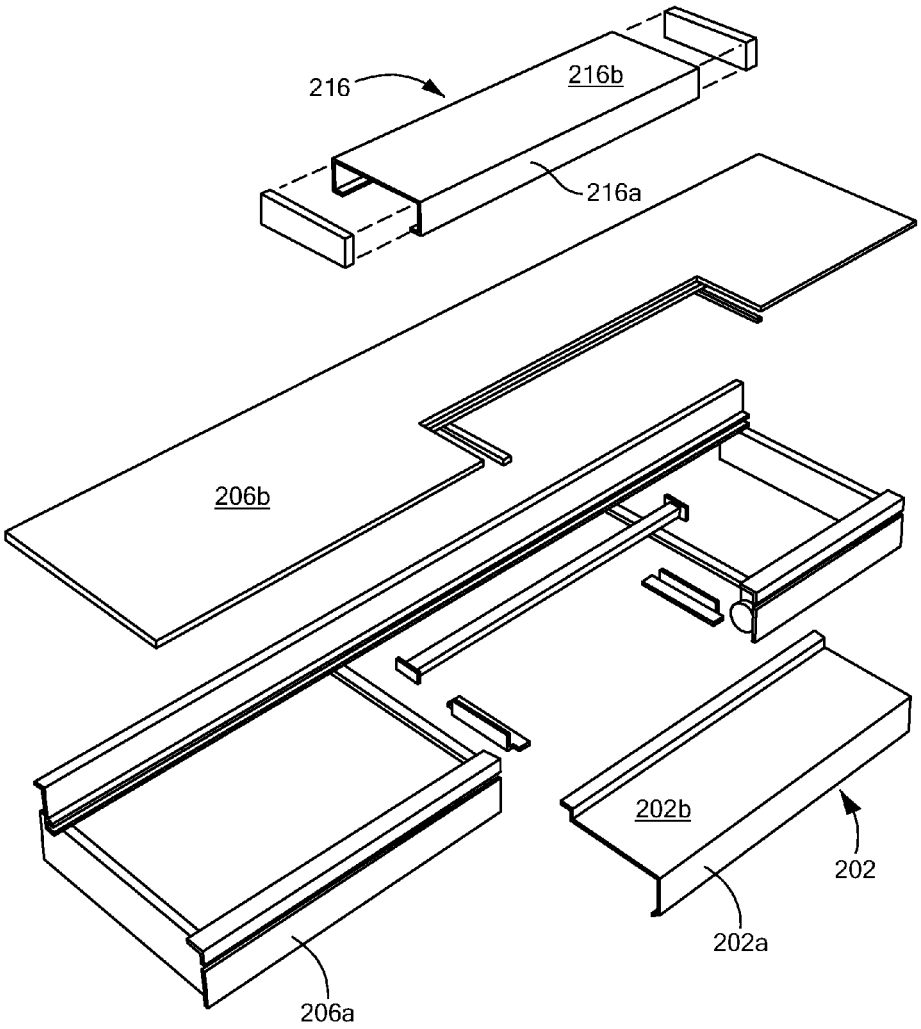
FIG. 4 is an exploded perspective view of a portion of the bleacher of FIG. 2 in accordance with the present invention illustrating components of the bleacher including exemplary structural frame members.

In accordance with one embedment of the present invention, a bleacher 200 having a front-aisle-step 202 that is integrated into a first row or deck 206 of the bleacher 200 is disclosed. An exemplary embodiment of the inventive bleacher is depicted in FIGS. 2-4. In the disclosed bleacher of FIGS. 2-4, the front step 100 that is depicted in FIG. 1 is eliminated altogether so as to avoid the disadvantages associated with that configuration.

In the presently disclosed bleacher 200, the front-aisle step 202 is disposed in a bleacher access-aisle 204 and integrated into a first row or deck 206. The illustrated bleacher 200 depicts only sections of the first row or deck 206 and a second row or deck 208 although the bleacher 200 may include any number of rows or decks and may have any desired width and number of access-aisles 204 located between seating structures or sections 212.

The first row or deck 206 of the bleacher 200 includes a riser 206*a* and a first deck surface 206*b* having a height $h_1$ above the support surface or floor. The second row or deck 208 of the bleacher 200 includes a riser 208*a* having a height that generally corresponds to the distance between the height $h_1$ of the surface 206*b* of the first deck 206 above the support surface or floor 210 and the height $h_2$ of the surface 208*b* of the second deck 208 above the support surface or floor 210.

Figure 1:
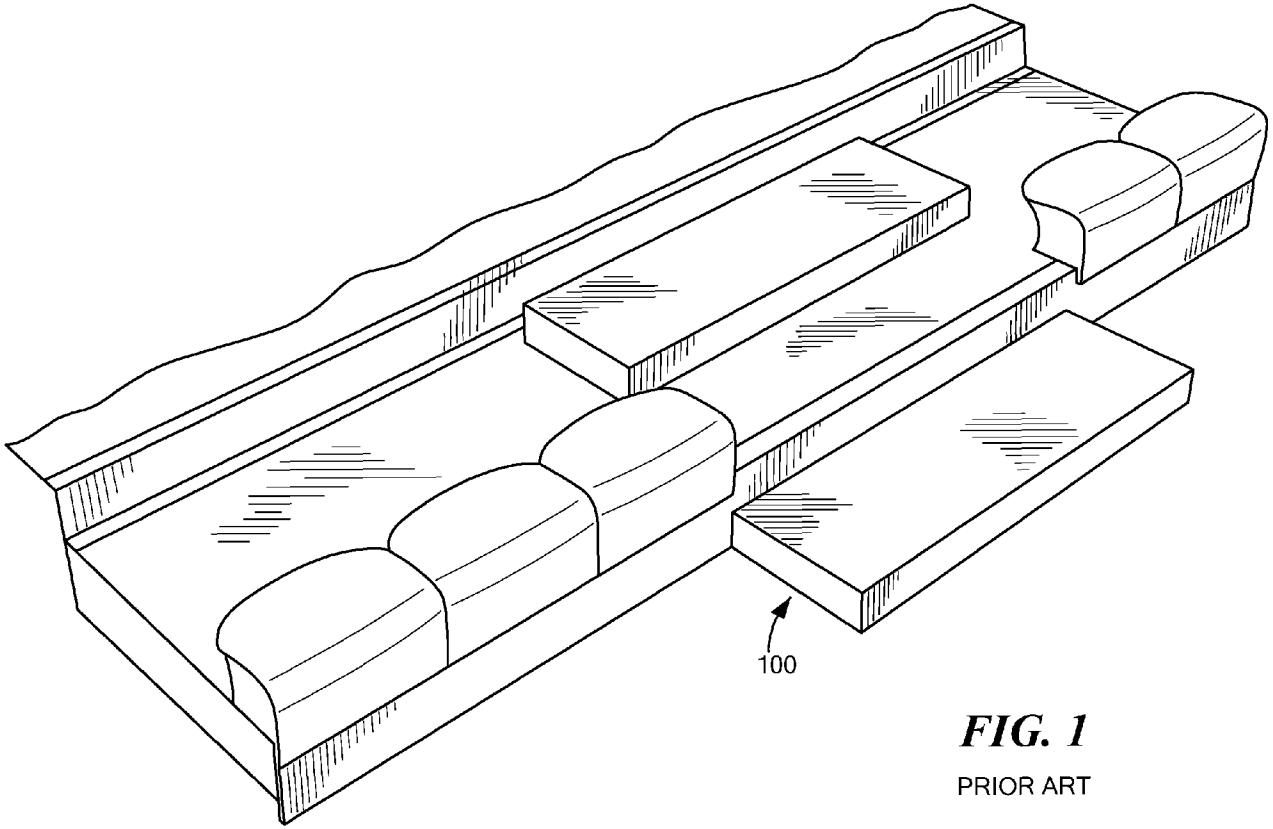
FIG. 1 PRIOR ART
FIG. 1 is a schematic representative of a portion of a prior art bleacher having a front-aisle step disposed on the gymnasium floor in front of the first row of bleacher seating.
Figure 2:
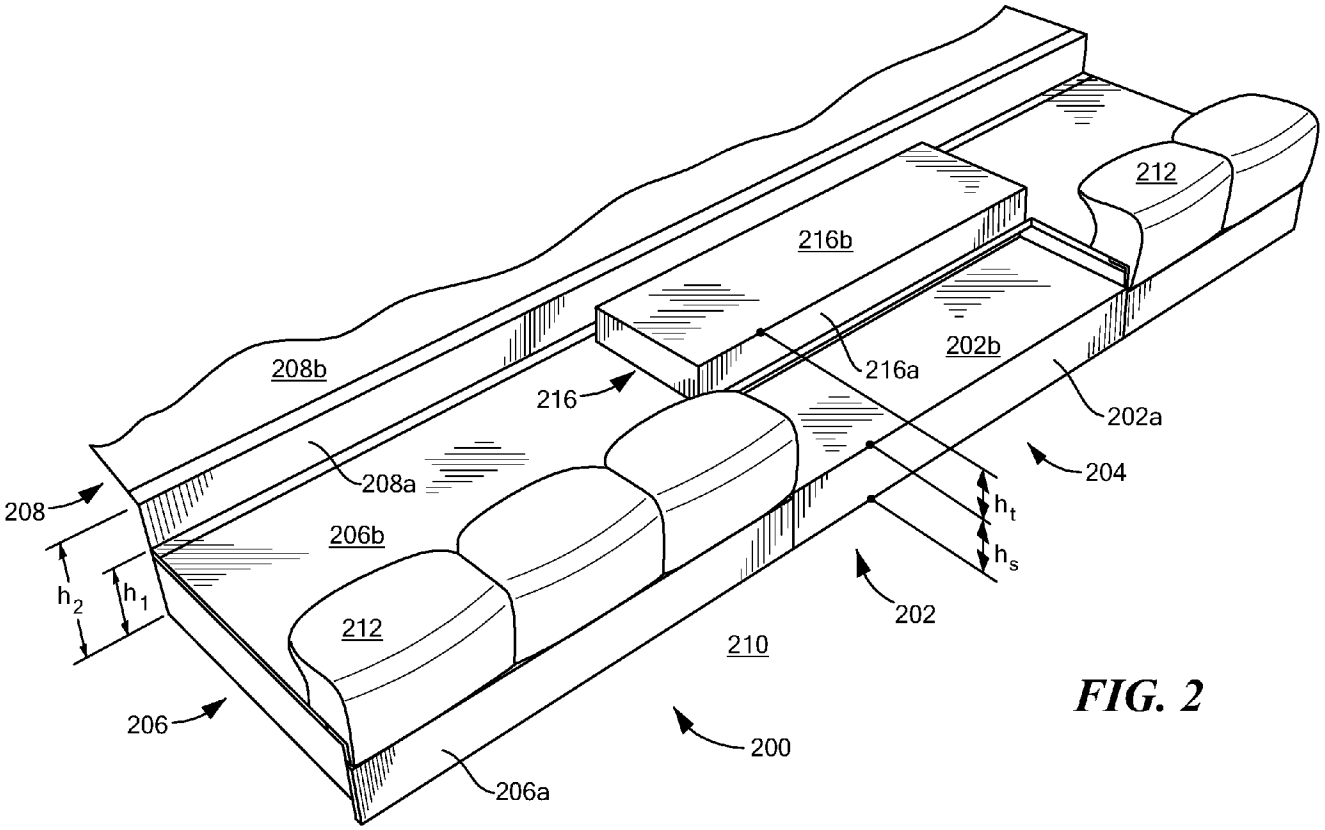
FIG. 2 is a perspective view of a portion of a bleacher in accordance with one embodiment of the present invention having a front-aisle step disposed in an access-aisle and having a first step height that is below a height of the first deck surface.

In the embodiment illustrated in FIG. 2, one step has been eliminated altogether from the embodiment illustrated in FIG. 1; i.e. from 4 step risers to the second deck (as illustrated in FIG. 1) to 3 step risers to the surface 208*b* of the second deck 208 (as illustrated in FIG. 2). This is achieved by increasing the riser heights of the first two or three steps in the access-aisle of the bleacher 200, while not exceeding the maximum building code allowed riser height (currently 8").

The bleacher 200 includes seating structures 212 on the deck surfaces. Seating structures 212 illustrated in FIG. 2 on the first deck surface 206*b* provide seating for users of the bleacher. Typically, seating structures 212 are provided on each deck surface. The seating structures 212 are disposed in the longitudinal direction and, in one embodiment, have a forward edge that is generally co-planar or nearly co-extensive with the forward edges of risers 206*a*, 208*a* of the first and second decks 206, 208 respectively. In an alternative embodiment, the seating structures may be disposed toward the rearward edge of the decks 206, 208. When the seating structures are disposed toward the rearward edge of a deck, the seating structures are mounted to an adjacent riser to permit retraction of the decks below the seating. One or more longitudinal gaps are provided in the seating structures 212 to define access-aisles 204 so as to permit user ingress to and egress from the bleacher 200.

The front-aisle step 202 has a height $h_s$ to the front-aisle step tread surface 202*b* that is at a code-allowed height (currently not greater than 8") above the support surface or floor 210 but lower than the height $h_1$ of the first row deck surface 206*b* (typically 10" to 12") above the support surface or floor 210. Front-aisle steps 202 are provided in each access-aisle 204 and are integrated into and mounted within the first row or deck 206. Steps may be marked with safety warnings indicating a rise variation different from other step riser heights on the bleacher 200 and may include a dedicated handrail (not shown in FIG. 2) mounted to one or more of the steps or to the bleacher 200 support structure. FIG. 3 shows the first row deck 206 and the front-aisle step 202 without the seats 212 installed. The front-aisle steps 202 include a forward edge or riser 202*a* that may be generally co-planar or generally flush with the forward edge or riser 206*a* of the first deck 206 of the bleacher 200 or recessed from the front edge or riser 206*a* of the first deck 206 of the bleacher 200 which corresponds to the forward edge of the bleacher 200. The forward edge 202*a* of the front-aisle step 202 is configured so as not to extend outward from the forward edge 206*a* of the bleacher in a manner that could create a tripping hazard to persons walking in front of the bleacher 200.

FIG. 4 shows an exploded view of one exemplary construction for integrating the front-aisle step 202 into the first row or deck 206 of the bleacher 200. It should be recognized that different understructures of the bleacher 200 will result in different approaches for the integration of the front-aisle step 202 into the first row of the bleacher 200 structure. A front structural beam, referred to as the nose beam 214, in the illustrated embodiment, is cut and removed or reformed. The nose beam 214 in the section of the first deck 206 is replaced with other structural components or replaced with a non-linear structural member to carry the loading on the front-aisle step 202 and the first deck 206 of the bleacher 200. Those components may include and are not limited to: the step(s) themselves, cross beams, deck outriggers, support braces or a front "skirt" panel among other possible components.

The decks, risers and/or steps of the bleacher may be mounted to a bleacher frame via fasteners and/or may comprise structural members which are interconnected one to the other and/or to structural frame members of the bleacher.

An intermediate step 216 includes an intermediate step riser 216*a* and an intermediate step tread 216*b* having an intermediate step surface. The intermediate step riser 216*a* has a riser height $h_t$ specified so as to achieve a comfortable and building code compliant riser height from the surface 202*b* of the front-aisle step 202 to the intermediate step surface 216*b* of the intermediate step 216 and additionally a comfortable and building code compliant riser height between an intermediate step surface of the intermediate step tread 216*b* of the intermediate step 216 and the second deck surface 208*b*.

Figure 5A:
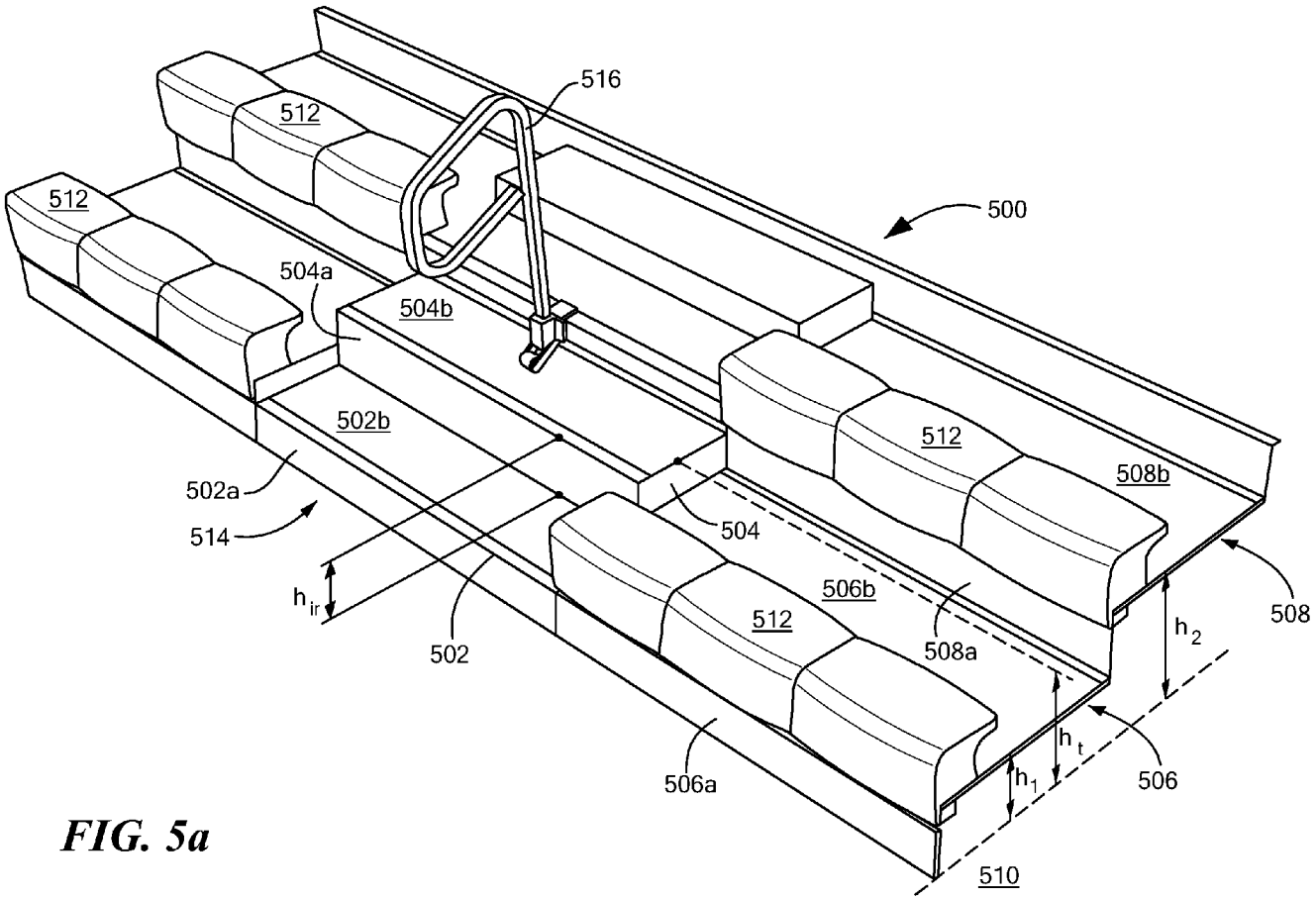
FIG. 5*a* is a perspective view in accordance with another embodiment of the present invention illustrating a bleacher including a front-aisle step and intermediate steps disposed in an access-aisle.
Figure 5B:
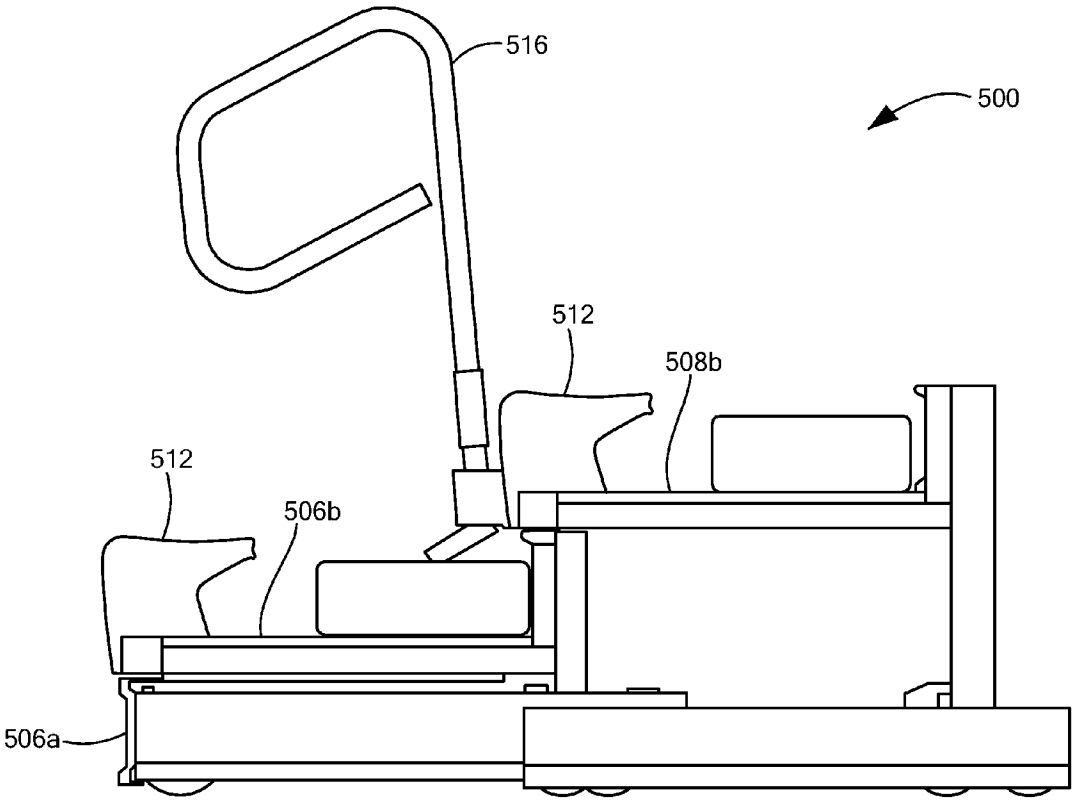
FIG. 5*b* is a side view of the bleacher of FIG. 5*a;*

Another embodiment of a bleacher 500 in accordance with the present invention includes a front-aisle step 502 and an intermediate step 504 as illustrated in FIGS. 5*a* and 5*b*. Referring to FIGS. 5*a* and 5*b*, the front-aisle step 502 includes a front-aisle step riser 502*a* and a front-aisle step tread 502*b* having a front-aisle or first step surface. An intermediate step 504 includes an intermediate step riser 504*a* and an intermediate step tread 504*b* having an intermediate step surface. The bleacher 500 includes at least first and second bleacher decks 506, 508 respectively. The first and second bleacher decks 506, 508 include first and second bleacher deck risers 506*a*, 508*a* and first and second bleacher deck surfaces 506*b*, 508*b* respectively. The first and second bleacher deck surfaces 506*b*, 508*b* have first and second bleacher deck surface heights $h_1$ and $h_2$ with respect to a support surface or floor 510 on which the bleacher 500 is disposed.

The first and second bleacher decks 506, 508 include seating structures 512 that provide seating for users of the bleacher 500. The seating structures 512 extending in the longitudinal direction include one or more gaps in such structures to provide one or more access-aisles 514 which permit user ingress to and egress from the bleacher 500. The front-aisle steps 502 and the intermediate steps 504 are disposed in the access-aisles 514 of the bleacher 500.

The front-aisle step 502 and the adjacent intermediate step 504 may be fabricated as a single integral continuous one piece member that in combination form the front-aisle step 502 and the intermediate step 504 that is adjacent the front-aisle step 502. By way of example, and not limitation, the front-aisle steps 502 and the intermediate steps 504 may be fabricated as a single continuous formed metal structure or fabricated from a structural plastic, plywood or a composite material. Alternatively, the front-aisle step 502 and the intermediate step 504 may be fabricated as separate step members and mounted to structural frame members of the bleacher 500 and/or other structural components of the bleacher 500 to retain the steps in position.

The front-aisle step 502 has a front-aisle step surface 502*b* with a height $h_s$ above the support surface 510 that is less than height $h_1$ of the first bleacher deck surface 506*b* above the support surface 510 to provide a comfortable and building code compliant tread height for the front-aisle step 502. Additionally, the intermediate step 504 adjacent the front-aisle step 502 has a tread height $h_t$ above the front-aisle step surface 502*b* that is specified such that the intermediate step riser height $h_{ir}$ provides a comfortable and building code compliant riser height from the front-aisle step tread 502*b* to the intermediate step tread 504*b* and from the surface of the intermediate step tread 504*b* to the second bleacher deck surface 508*b*.

The front-aisle step riser 502*a* is generally co-planar with or recessed from the first bleacher deck riser 506*a* so as not to present a tripping hazard for persons walking in front of the bleacher 500. Additionally, one or more handrails 516 may be mounted to the bleacher 500 within the access-aisles 514.

The presently disclosed bleacher provides a front-aisle step that is integrated into the first row or deck of the bleacher. More specifically, the presently disclosed bleacher having an integrated front-aisle step eliminates a separate or attached "front-aisle step" that protrudes in front of a telescopic bleacher. Additionally, the presently disclosed front-aisle step is integrated into the first row or deck of the bleacher to avoid the placement and removal of step members as has traditionally been required in the prior art as illustrated in FIG. 1. Furthermore, in certain embodiments, the front-aisle step that has a forward edge or riser that is nearly "flush" with the other front features of the bleacher or recessed from the forward edge of the bleacher but does not extend outward beyond the forward edge of the bleacher so as to avoid a tripping hazard.

Moreover, in certain embodiments, the disclosed front-aisle step, along with an intermediate step, has a greater combined riser height than the riser heights of each bleacher deck. Additionally, in certain embodiments, the interruption of the continuous front structural member or members of the first row bleacher deck is accommodated by the substitution, for that member, of one or more other structural members integrated into the first row or deck to provide support for the front-aisle step(s). Finally, in certain embodiments, hand-rails may be mounted to nose rails, the deck structures or bleacher frame members to assist users to safely ascend and descend the steps in the access-aisles.

In another embodiment illustrated by reference to FIGS. 6*a*, 6*b*, 7*a* and 7*b*, a reversible platform is provided that may be mounted in a bleacher access-aisle to provide a first or a second step height from the bleacher support surface or floor to the front-aisle step surface, i.e. the first step surface upon ingress to the bleacher.

Figure 7A:
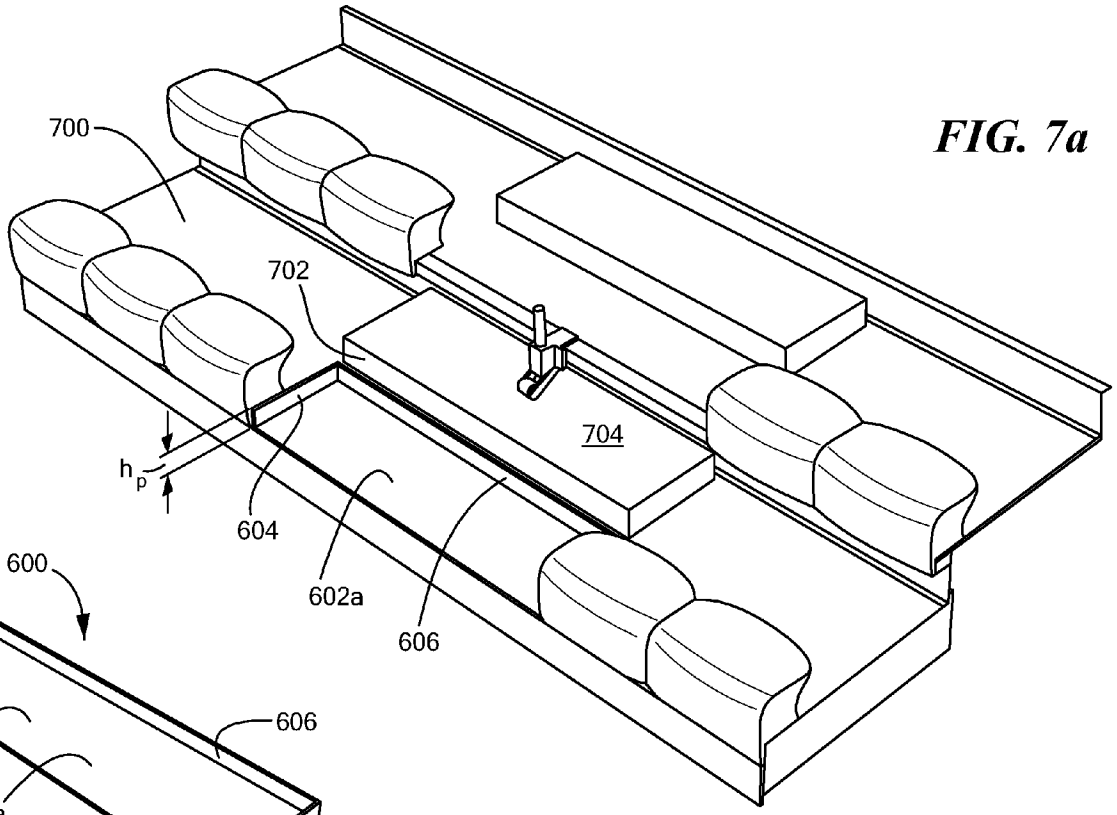
FIG. 7*a* is a perspective view of a bleacher in accordance with the present invention having the reversibly mountable platform of FIG. 6*a* disposed in the bleacher access-aisle in the first orientation to provide a first aisle step surface at a height above the support surface that is less than the height of the first bleacher deck surface above the support surface.
Figure 6A:
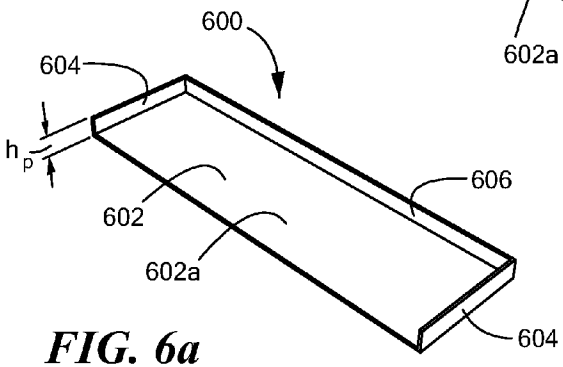
FIG. 6*a* is a first perspective view of a reversibly mountable platform that is mountable in a first orientation in a bleacher access-aisle to provide a first aisle step surface that is below the level of the first decking surface and that is mountable in a second orientation in the bleacher aisle to provide a first aisle step surface that is substantially even with the first decking surface.
Figure 6B:
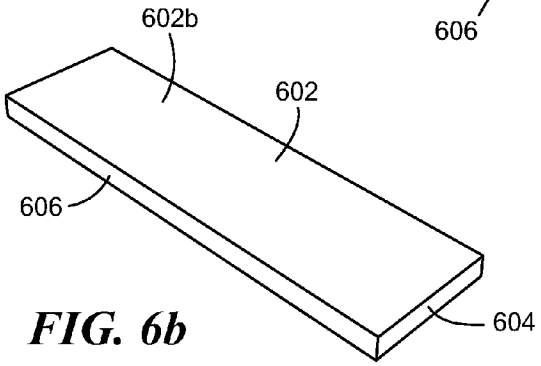
FIG. 6*b* is an inverted perspective view of the reversibly mountable platform of FIG. 6*a;*

More specifically referring to FIG. 6*a*, a reversible platform 600 includes a generally planar member 602, side portions 604 and a cross-member 606. The generally planar member 602 of the reversible platform 600 has opposing sides 602*a* (FIG. 6*a*) and 602*b* (FIG. 6*b*). The reversible platform 600 may be disposed in the aisle in a first orientation with the side 602*a* of the planar member 602 facing upward and side portions 604 and the cross-member 606 extending upward as illustrated in FIGS. 6*a* and 7*a*. In this first orientation, the reversible platform 600 is supported by structural members (not shown) of the bleacher or secured to other structural or bleacher components. In the first orientation, the thickness of the planar member adds minimal height to the level of the first aisle step of the bleacher. In this first orientation, the planar member surface 602*a* forms the surface of the front-aisle or first step of the bleacher and the platform surface 602*a* is below the level of the first bleacher deck surface 700. In the illustrated embodiment, the first step surface 602*a* is below the first deck surface 700 by a height "$h_p$" as illustrated in FIGS. 6*a* and 7*a* which corresponds to the height of the side members 604 of the reversible platform. Though in the illustrated embodiment, the height "$h_p$" is substantially equal to the height of the side portions 604 the riser height between the surface 602*a* and the first step surface may be greater than the height $h_p$ of the side portions. When the reversible platform 600 is disposed or mounted in the access-aisle in the first orientation, the upward extending cross-member 606 may be disposed adjacent the riser 702 of intermediate step 704 or alternatively, may be recessed within the riser so that the forward facing surface of the cross-member 606 is substantially flush and forms a portion of the riser extending from the first step surface 602*a* to the intermediate step surface 704.

Figure 7B:
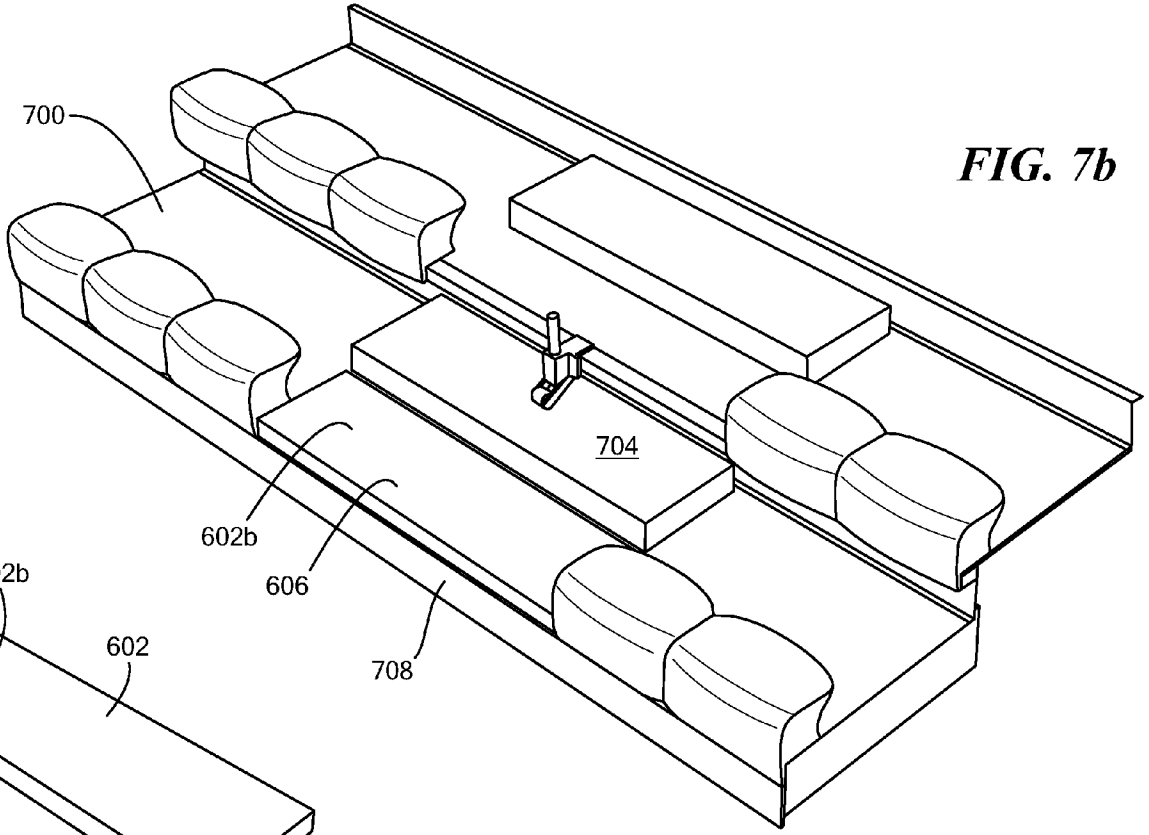
FIG. 7*b* is a perspective view of a bleacher with the reversibly mountable platform illustrated in FIG. 6*b* disposed in the bleacher access-aisle in the second orientation to provide a first aisle step surface at a height above the support surface that is substantially co-planar with the first bleacher deck surface.

When the reversible platform 600 is inverted, as illustrated in FIG. 6*b*, the surface 602*b* of the reversible platform 600 is upward facing and platform side portions 604 and the cross-member 606 extend downward from the generally planer member 602. In this inverted orientation, the reversible platform 600 is disposable or mountable in the bleacher access-aisle in the second orientation as illustrated in FIG. 7*b* between the front edge of the bleacher and the riser 702 of the intermediate step 704. In this second orientation, the front-aisle step surface 602*b* is at a level that is substantially co-planar with the first deck surface 700 in one embodiment. The underside of the platform may be supported by one or more bleacher members (not shown) to avoid deformation of the step surface when the step is traversed by a user. The reversible platform 600 may be retained in position via fasteners, such as bolts or any other suitable fasteners that secure the platform 600 to cooperative structural members. In one embodiment, the cross-member 606 is generally co-planar with the front edge of the front-aisle step riser 708 as illustrated in FIG. 7*b*. The cross-member 606 and the front-aisle step riser 708 may be substantially co-planar with the forward edge of the bleacher or recessed from the forward edge of the bleacher (not shown) so as avoid a tripping hazard for persons walking in front of the bleacher.

It should be recognized that the presently disclosed front-aisle step that is integrated into the first deck of a bleacher may be employed in telescoping bleachers that are extendable and retractable or in fixed bleacher installations.

While the above-described reversible platform is described as providing a first aisle step surface that is below the level of the first deck surface or a first aisle step surface that is substantially level with the first deck surface, it should be also appreciated that the reversible platform disclosed herein may be employed to provide a first aisle step surface that is below the first deck surface in a first orientation of the platform and, upon reversal of the platform, a first-aisle step surface that is at a height above the height of the first aisle step surface in the first orientation but at a height that is not at a level that is co-planar with the first deck surface.

It should also be recognized by those of ordinary skill in the art that modifications to and variations of the above-described bleacher having an integrated front-aisle step and a reversible platform as disclosed and method for fabricating and using such a bleacher may be made without departing from the inventive concepts disclosed herein. Accordingly, the invention is not to be viewed as limited except by the scope and content of the appended claims.

What is claimed is:

1. A bleacher having a front edge extending in a longitudinal direction, the bleacher for installation on a support surface and comprising:

a bleacher frame;

at least first and second bleacher decks mounted to the bleacher frame, the first and second bleacher decks each having a bleacher deck surface, the first and second bleacher deck surfaces disposed at first and second heights above the support surface, wherein the second height is greater than the first height, the first bleacher deck disposed between the bleacher front edge and a riser extending vertically to the second bleacher deck, the second bleacher deck mounted to the bleacher frame rearward of the first bleacher deck;

at least a pair of seating sections extending above each of the first and second bleacher decks, the seating sections of each pair of seating section being spaced from one another to define an access aisle for ingress to and egress from the bleacher that is generally transverse to the longitudinal direction; and a first step within the access aisle, the first step having a first step surface having a forward edge generally co-extensive with the front edge of the bleacher or recessed from the front edge of the bleacher, wherein the first step comprises a reversible platform having opposing first and second platform surfaces and wherein:

the reversible platform is mountable within the access aisle at a mounting location in a first orientation and configured such that the first platform surface corresponds to the first step surface and the first step surface is at a third height above the support surface that is less than the first height above the support surface, and the reversible platform is mountable within the access aisle at the mounting location in a second orientation in which the platform is inverted from the first orientation and configured such that the second platform surface corresponds to the first step surface and the first step surface is at a fourth height above the support surface that is different from the third height above the support surface.

2. The bleacher of claim 1 wherein the first step comprises a metal, plastic, plywood or a composite material.

3. The bleacher of claim 1 further including an intermediate step within the access aisle, the intermediate step having a height above the support surface that is greater than the height of the first step surface above the support surface and less than the height of the second deck surface above the support surface, the intermediate step surface extending generally from a rearward edge of the first step to the riser.

4. The bleacher of claim 3 wherein the intermediate step comprises a metal, plastic, plywood or composite material.

5. The bleacher of claim 1 wherein the fourth height above the support surface generally equals the first height above the support surface.

* * * * *